US006172942B1

(12) United States Patent
Ogasawara et al.

(10) Patent No.: US 6,172,942 B1
(45) Date of Patent: Jan. 9, 2001

(54) ANALOG ELECTRONIC WATCH

(75) Inventors: Kenji Ogasawara; Teruaki Hanzaki, both of Chiba (JP)

(73) Assignee: Seiko Instruments Inc. (JP)

( * ) Notice: Under 35 U.S.C. 154(b), the term of this patent shall be extended for 0 days.

(21) Appl. No.: 09/248,517

(22) Filed: Feb. 9, 1999

(30) Foreign Application Priority Data

Feb. 10, 1998 (JP) ..... 10-28913

(51) Int. Cl.[7] ..... G04F 5/00
(52) U.S. Cl. ..... 368/157; 368/160; 318/696
(58) Field of Search ..... 368/157, 160; 318/696

(56) References Cited

U.S. PATENT DOCUMENTS 4,271,773 * 6/1981 makabe et al. ..... 112/158 E
4,302,828 * 11/1981 Morokawa et al. ..... 368/69
4,302,829 * 11/1981 Morokawa et al. ..... 368/82
5,028,857 * 7/1991 Taghezout ..... 368/157

* cited by examiner

*Primary Examiner*—Bernard Roskoski
(74) *Attorney, Agent, or Firm*—Adams & Wilks

(57) ABSTRACT

An output of an oscillating circuit is inputted to a system clock generating circuit, and a CPU performing various arithmetic processes is operated by this system clock.

In order to operate a chopping pulse generating circuit and a one-shot pulse generating circuit, the CPU enters into an interrupt operation by means of an interrupt signal from an interrupt signal generating circuit, pulse information of a pulse rank storage circuit which stores a duty width of the chopping pulse generating circuit and pulse information of the one-shot pulse generating circuit, are independently controlled by means of rotation detection information of a rotation detecting circuit in previous driving of a motor, and the motor is driven by means of motor driving pulses formed by the chopping pulse generating circuit and the one-shot pulse generating circuit.

2 Claims, 6 Drawing Sheets

| PULSE RANK STORAGE CIRCUIT | | | | | |
|---|---|---|---|---|---|
| CHOPPING PULSE CONTROL BIT | | | | ONE-SHOT PULSE CONTROL BIT | |
| D3 | D2 | D1 | DUTY RATIO On/Off | D0 | OUTPUT |
| 0 | 0 | 0 | 8 : 8 | 0 | INEXISTANCE |
| 0 | 0 | 0 | 8 : 8 | 1 | EXISTANCE |
| 0 | 0 | 1 | 9 : 7 | 0 | INEXISTANCE |
| 0 | 0 | 1 | 9 : 7 | 1 | EXISTANCE |
| 0 | 1 | 0 | 10 : 6 | 0 | INEXISTANCE |
| 0 | 1 | 0 | 10 : 6 | 1 | EXISTANCE |
| 0 | 1 | 1 | 11 : 5 | 0 | INEXISTANCE |
| 0 | 1 | 1 | 11 : 5 | 1 | EXISTANCE |
| 1 | 0 | 0 | 12 : 4 | 0 | INEXISTANCE |
| 1 | 0 | 0 | 12 : 4 | 1 | EXISTANCE |
| 1 | 0 | 1 | 13 : 3 | 0 | INEXISTANCE |
| 1 | 0 | 1 | 13 : 3 | 1 | EXISTANCE |
| 1 | 1 | 0 | 14 : 2 | 0 | INEXISTANCE |
| 1 | 1 | 0 | 14 : 2 | 1 | EXISTANCE |
| 1 | 1 | 1 | 15 : 1 | 0 | INEXISTANCE |
| 1 | 1 | 1 | 15 : 1 | 1 | EXISTANCE |

ANALOG ELECTRONIC WATCH

BACKGROUND OF THE INVENTION

1. Field of the Invention

The Present invention relates to an analog electronic watch including a microcomputer. Particularly, the present invention relates to an analog electronic watch in which low consumption motor driving is controlled by a microcomputer.

2. Description of the Prior Art

Conventionally, in an analog electronic watch, in order to suppress consumed electric current of a motor, the width of a rectangular pulse is made variable or the duty of a chopping pulse is made variable as disclosed in Japanese Patent Unexamined Publication No. Sho. 54-101367, so that the motor is driven by minimal driving pulses. It is known that according to the chopping pulse, pulses are applied intermittently to a motor, so that the peak current of the motor is lowered as compared with the rectangular pulse.

However, in a conventional analog electronic watch, if the duty of the chopping pulse is raised by one rank, in the case of a base oscillation of 32 kHz, the pulse On-time is increased by multiplying 31 $\mu$s by the number of chopping pulses, and further, the Off-time of the chopping pulse becomes narrow, so that the peak current is also raised and rather a large current loss is caused. Moreover, in order to make the duty more finely variable, an ineffective method, such as a method of forming a clock faster than a base oscillation by using a frequency multiplying circuit, has been performed.

SUMMARY OF THE INVENTION

In order to solve the above problems, a first aspect of the present invention is made of such a structure as comprises an oscillation circuit, a frequency dividing circuit for dividing an output of the oscillation circuit, a system clock generating circuit for generating a system clock from an output of the oscillation circuit, a ROM in which procedures, such as a clocking operation of a watch, are programmed, a CPU for decoding data programmed in the ROM and for performing various arithmetic processes, a RAM for storing various data, an interrupt signal generating circuit for generating an interrupt signal to the CPU, a chopping pulse generating circuit which receives a timing signal from the frequency dividing circuit and causes a duty of a chopping pulse to be variable, a one-shot pulse generating circuit which receives an end signal of a motor driving pulse outputted from the chopping pulse generating circuit and a timing signal from the frequency dividing circuit, and outputs a one-shot pulse, a pulse rank storage circuit for storing pulse states of the chopping pulse generating circuit and the one-shot pulse generating circuit, a motor driver circuit which receives outputs of the chopping pulse generating circuit and the one-shot pulse generating circuit and drives a motor, a motor driven by the motor driver circuit, and a rotation detecting circuit for detecting rotation/non-rotation of the motor.

A second aspect of the present invention is made of such a structure as comprises the one-shot pulse generating circuit which receives a timing signal from the frequency dividing circuit and outputs a one-shot pulse, and the chopping pulse generating circuit which receives an end signal of a motor driving pulse outputted from the one-shot pulse generating circuit and a timing signal from the frequency dividing circuit, and causes the duty of the chopping pulse to be variable.

BRIEF DESCRIPTION OF THE DRAWINGS

A preferred form of the present invention is illustrated in the accompanying drawings in which.

DETAILED DESCRIPTION OF THE PREFERRED EMBODIMENTS (1) First Embodiment

Figure 1:
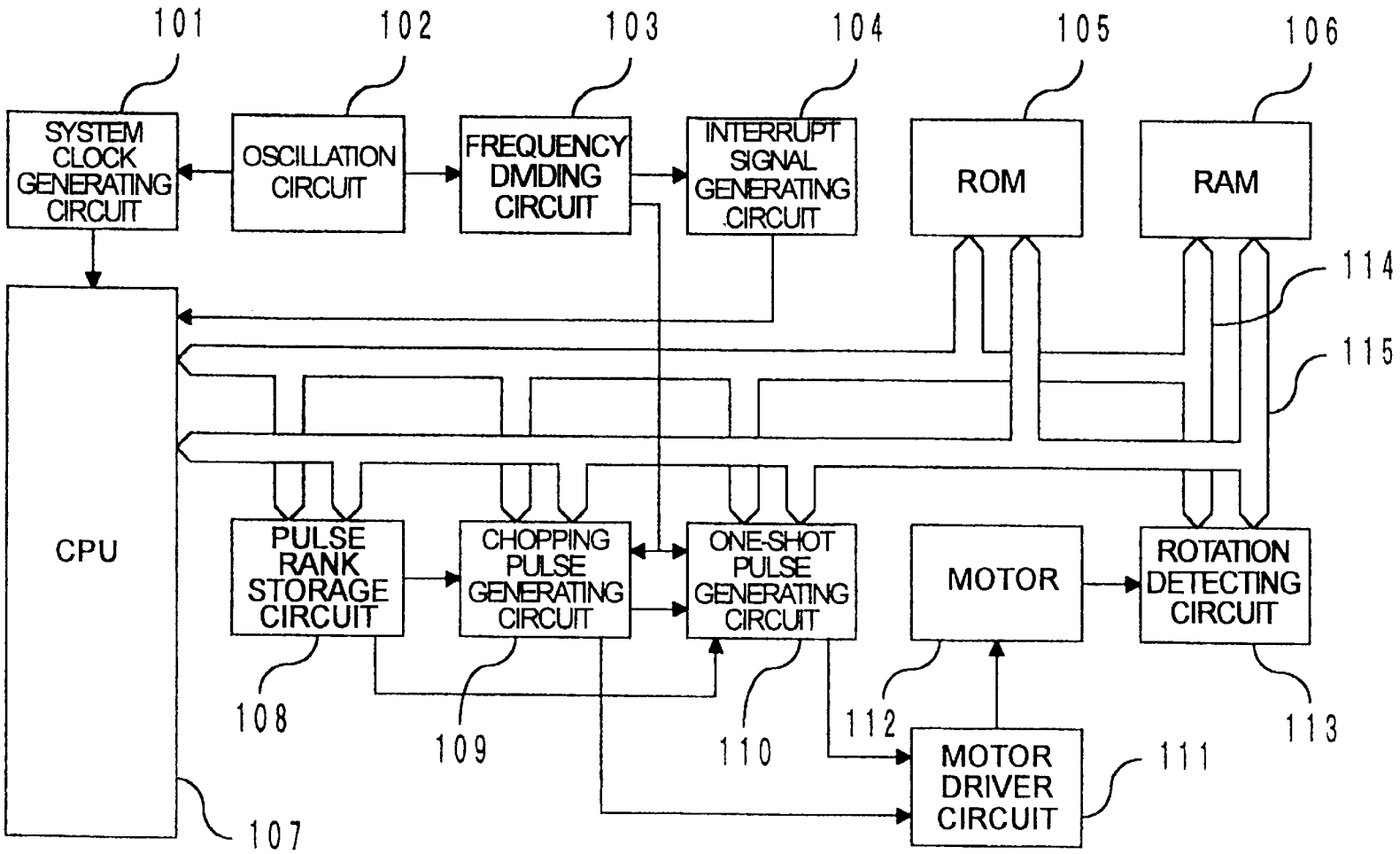
FIG. 1 is a functional block diagram showing an example of a first embodiment of an analog electronic watch of the present invention.

FIG. 1 is a functional block diagram showing a typical structure of a first embodiment of the present invention.

In FIG. 1, an output of an oscillation circuit 102 is inputted to a system clock generating circuit 101, and a CPU 107 performing various arithmetic processes is operated by the system clock.

In order to operate a chopping pulse generating circuit 109 and a one-shot pulse generating circuit 110, the CPU 107 enters into an interrupt operation by an interrupt signal from an interrupt signal generating circuit 104, the address of a ROM 105 is first determined, and programming data are transmitted to the CPU 107 through a data bus 114. The CPU 107 decodes the programming data, and performs various arithmetic processes. An address bus 115 selects a detection result output address of a rotation detecting circuit 113 by means of the data of the ROM 104, and on the basis of rotation detection information in previous driving of a motor 112, 4-bit pulse information of a pulse rank storage circuit 108 storing a duty width of the chopping pulse generating circuit 109, which can be selected by three bits, and pulse information of the one-shot pulse generating circuit 110, which changes the existence/inexistence of a pulse output by one bit, are independently controlled by means of the data of the ROM 105, the chopping pulse generating circuit 109 outputs a motor driving pulse by means of a timing signal of a frequency dividing circuit 103, the one-shot pulse generating circuit 110 receives an end signal of the motor driving pulse outputted from the chopping pulse generating circuit 109 and the timing signal from the frequency dividing circuit 103, and outputs a one-shot motor driving pulse, and the respective motor driving pulses drive the motor 113 through the motor driver circuit 111.

Figure 3:
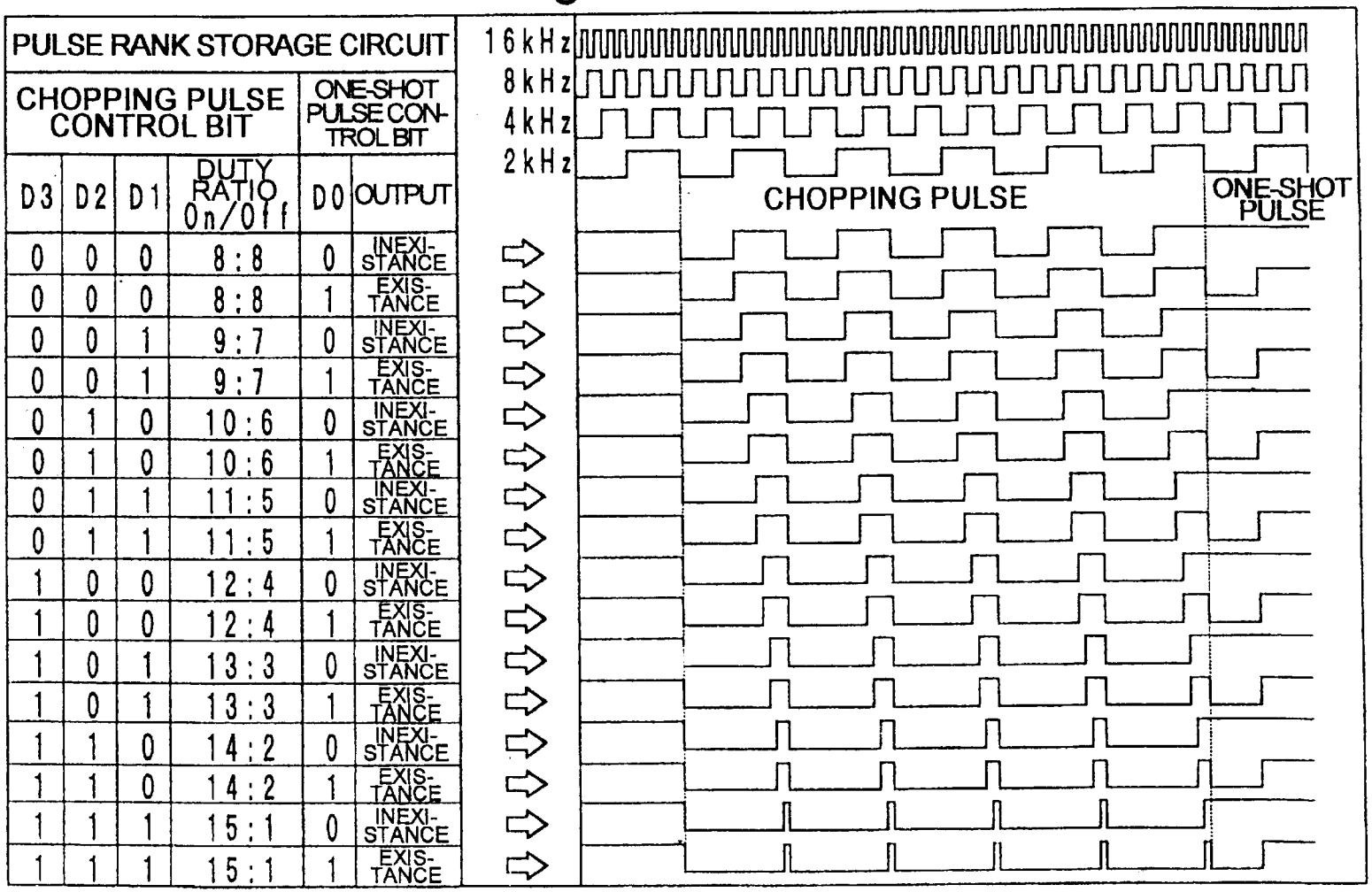
FIG. 3 is a table showing structure of data of a pulse rank storage circuit of an analog electronic watch of the present invention and motor driving pulse waveforms corresponding to the data.

FIG. 3 is a table showing structure of data of the pulse rank storage circuit 108 in the analog electronic watch of the present invention and motor driving pulse waveforms corresponding to the data.

In FIG. 3, the pulse rank storage circuit 108 is made of four bits, three bits of D3 to D1 are bits for controlling duty variation of the chopping pulse generating circuit 109, and one bit of D0 is a bit for controlling the existence/inexistence of an output of a one-shot pulse. By means of the data of the ROM 105, the CPU 107 selects an address of the pulse rank storage circuit 108 through the address bus 115, and makes increment of the data of the four bits of D3 to D1, so that it is possible to alternately control the output of a one-shot pulse and the rank up of a duty ratio. It is also possible to control only the duty variation by fixing the data of D0 to 0 according to a motor used.

Figure 4:
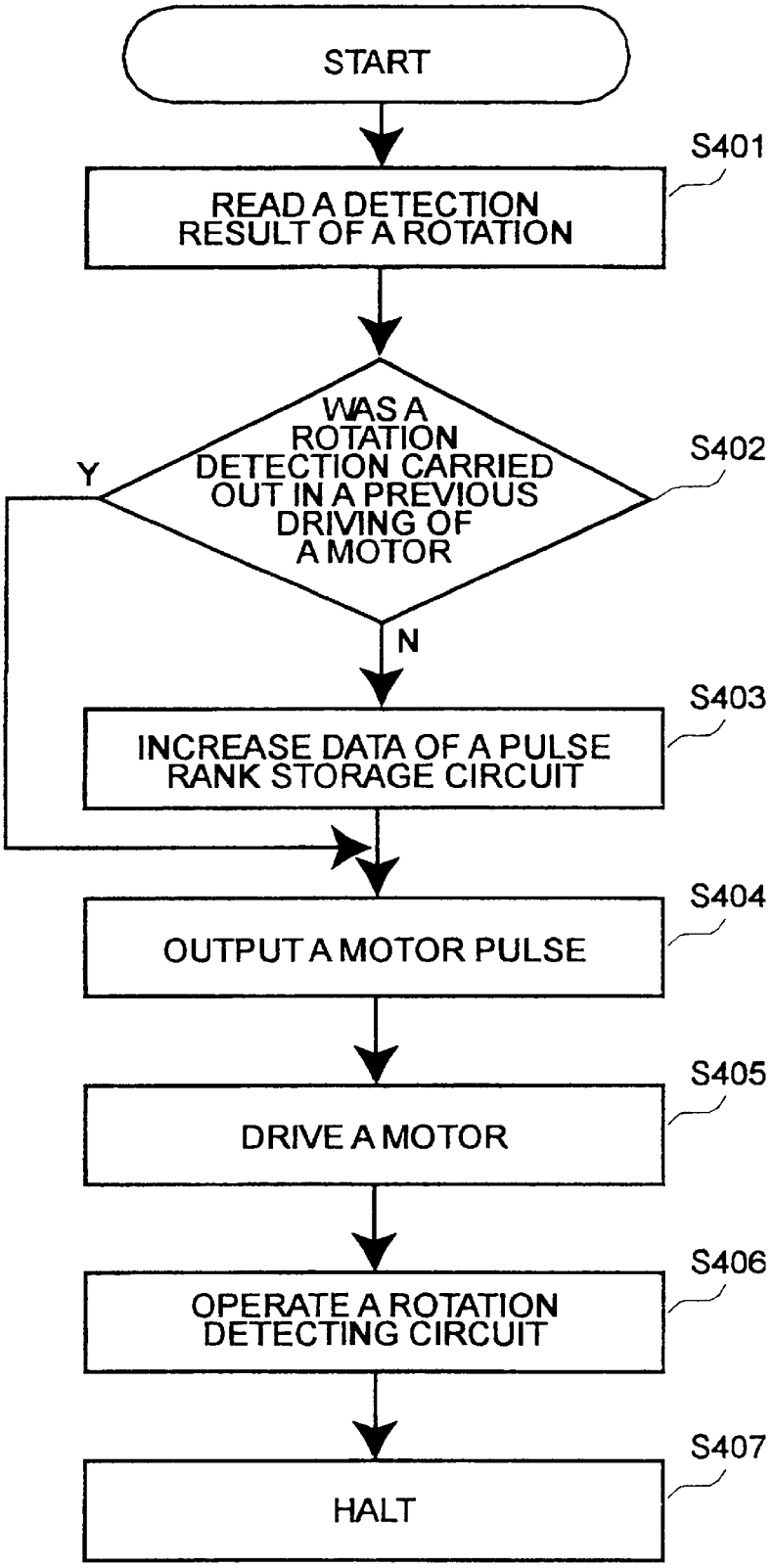
FIG. 4 is a flow chart showing the operation of motor driving pulse control of an analog electronic watch of the present invention.

FIG. 4 is a flow chart showing the operation of motor driving pulse control in the analog electronic watch of the present invention.

In FIG. 4, the CPU 107 enters into an interrupt operation by means of an interrupt signal from the interrupt signal generating circuit 104, and reads the detection result of the rotation detecting circuit 113 in previous driving of the motor 112 (S401). It is judged whether rotation detection was carried out in the previous driving of the motor 112 (S402), and if the rotation detection was carried out, the process branches to S404, and if the rotation detection was not carried out, the process branches to S403. In the case where the rotation detection was not carried out, increment of the four-bit data of the pulse rank storage circuit 108 is made (S403). In accordance with the pulse information of the pulse rank storage circuit 108, the chopping pulse generating circuit 109 and the one-shot pulse generating circuit 110 are operated by the timing signal of the frequency dividing circuit 103, so that motor driving pulses are outputted (S404). The motor driver circuit 111 receives the outputted motor driving pulses and drives the motor 112 (S405). The rotation detecting circuit 113 is operated and the rotation/non-rotation of the motor 112 is detected (S406). The CPU 107 is stopped and enters into a HALT operation (S407).

Figure 5:
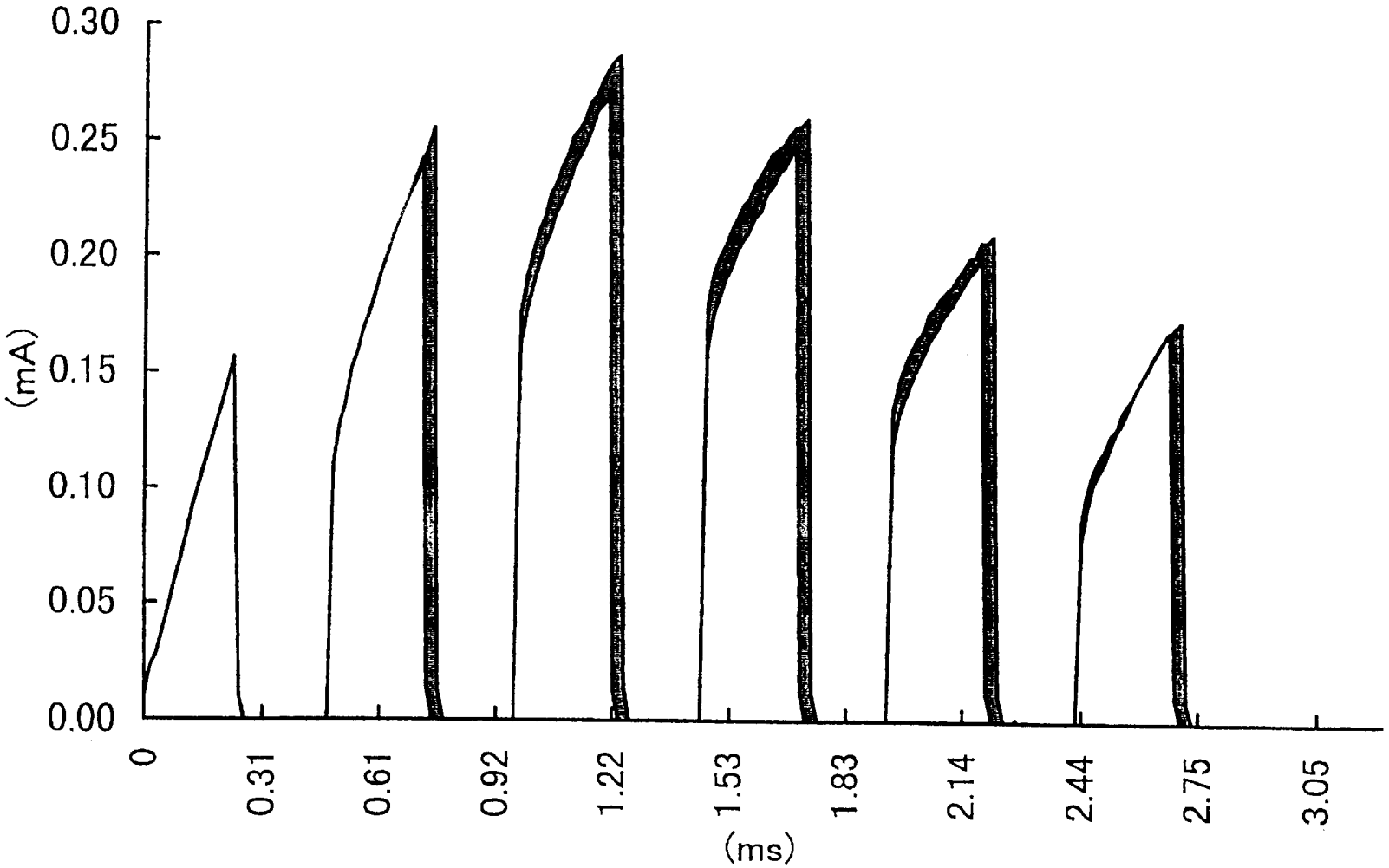
FIG. 5 is an electric current waveform of a motor showing an example of an analog electronic watch of the present invention.

FIG. 5 is a graph comparing a current waveform of the motor 112 in the case where the duty ratio of the chopping pulse is 8:8 and the output of the one-shot pulse does not exist, to a current waveform of the motor 112 in the case where the duty ratio of the chopping pulse is 9:7 and the output of the one-shot pulse does not exist.

In FIG. 5, the duty ratio is made 9:7, that is, the duty ratio of the chopping pulse is raised by one rank, so that an On-time of a pulse is increased, and the peak current of the respective pulses is raised, and as compared with the current waveform of the duty ratio of 8:8, the slant portion is increased.

Figure 6:
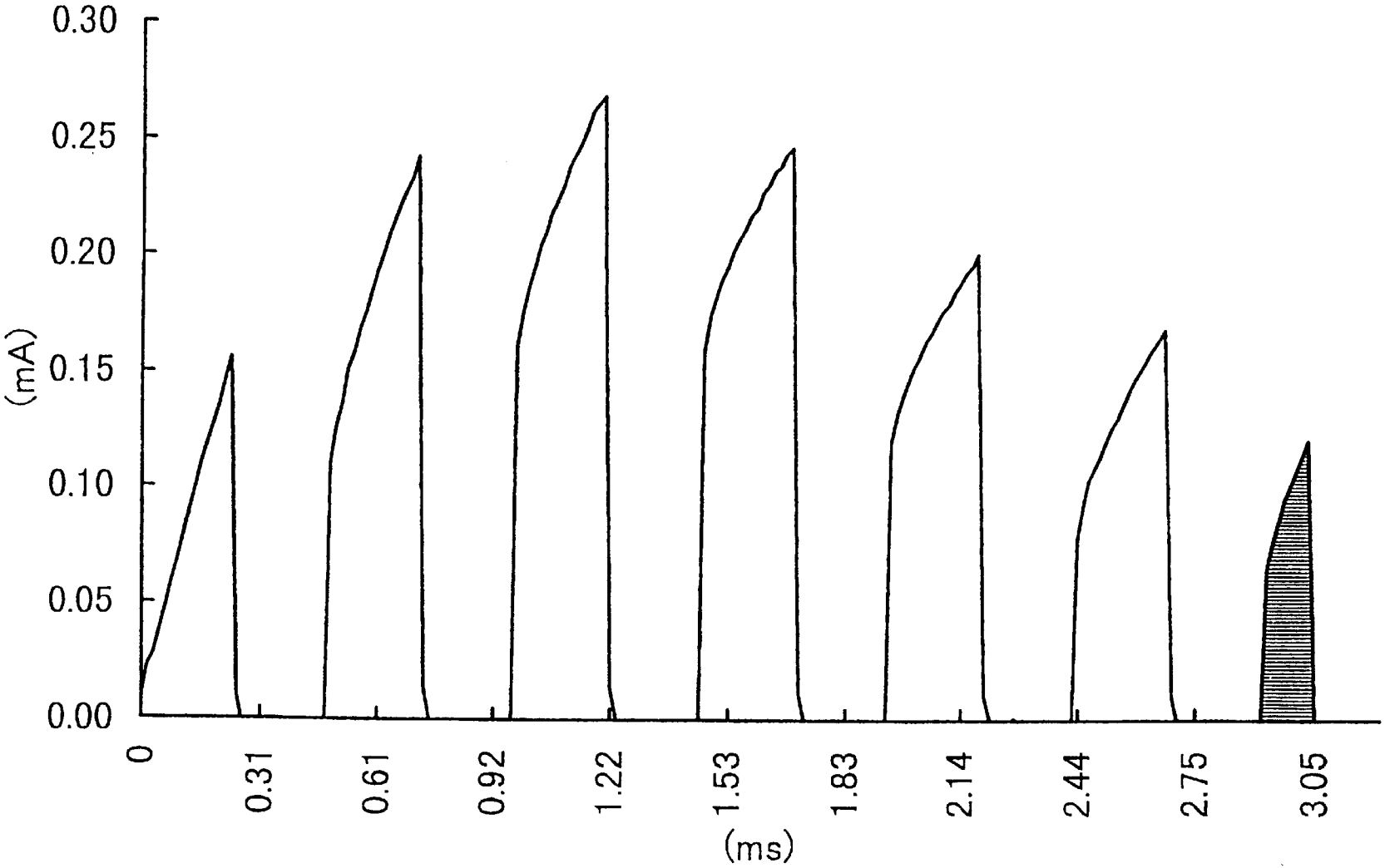
FIG. 6 is an electric current waveform of a motor showing an example of an analog electronic watch of the present invention.

FIG. 6 is a graph comparing a current waveform of the motor 112 in the case where the duty ratio of the chopping pulse is 8:8 and the output of the one-shot pulse does not exist, to a current waveform of the motor 112 in the case where the duty ratio of the chopping pulse is 8:8 and the output of the one-shot pulse exists.

In FIG. 6, since the duty ratio is not changed, the current of the chopping pulse is not changed, and an electric current is increased by the output of the one-shot pulse outputted after the chopping pulses, so that the pulse becomes an intermediate driving pulse between the chopping pulse of 8:8 and the chopping pulse of 9:7.

(2) Second Embodiment

Figure 2:
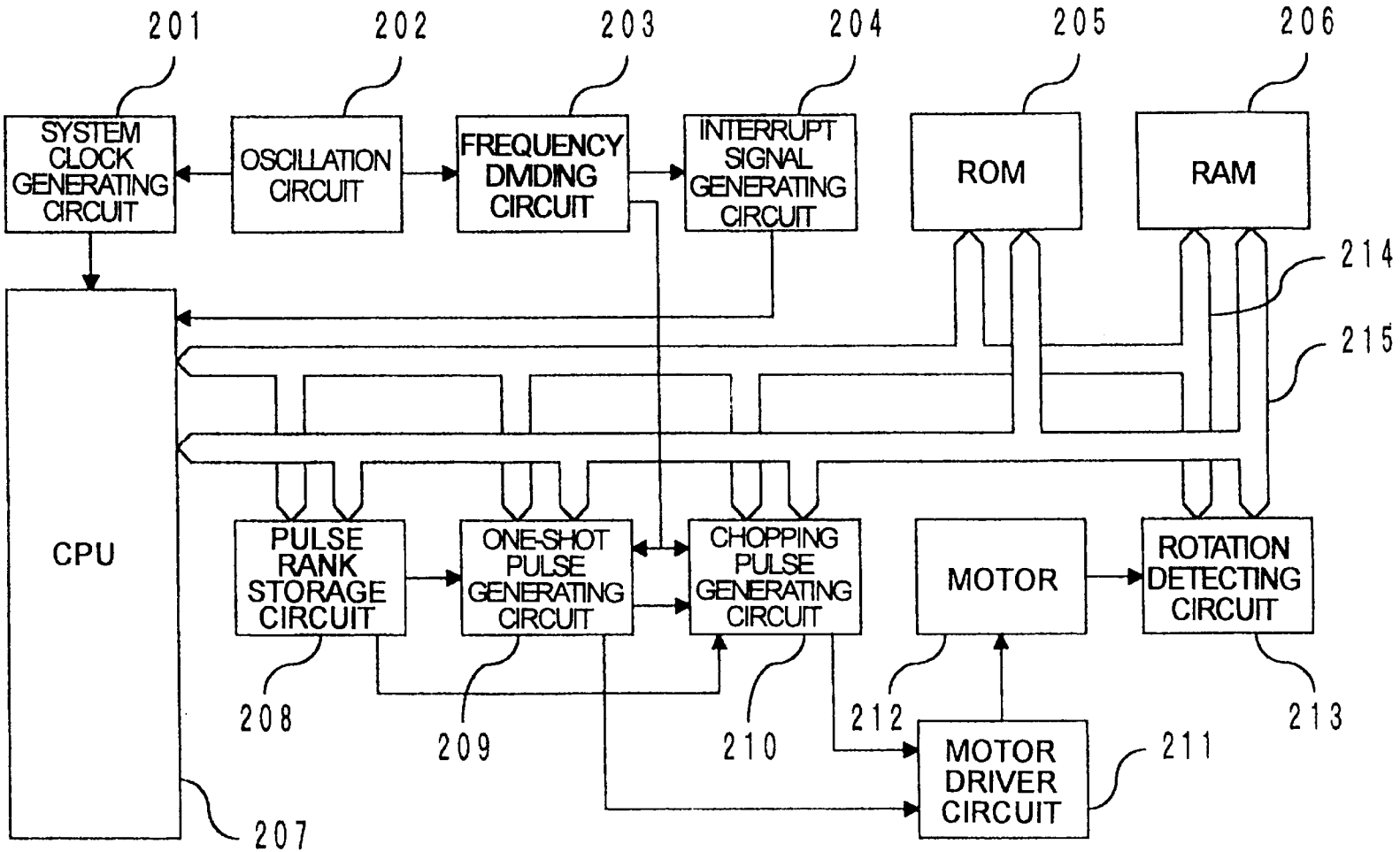
FIG. 2 is a functional block diagram showing an example of a second embodiment of an analog electronic watch of the present invention.

FIG. 2 is a block diagram showing a typical structure of a second embodiment of the present invention.

In FIG. 2, the output sequence of pulses from a chopping pulse generating circuit 210 and a one-shot pulse generating circuit 209 is changed, 4-bit pulse information of a pulse rank storage circuit 208 are independently controlled by means of data of a ROM 205, the one-shot pulse generating circuit 209 outputs a one-shot motor driving pulse by means of a timing signal of a frequency dividing circuit 203, the chopping pulse generating circuit 210 receives an end signal of the motor driving pulse outputted from the one-shot pulse generating circuit 209 and a timing signal from the frequency dividing circuit 203 and outputs a motor driving pulse from the chopping pulse generating circuit, and the respective motor driving pulses drive a motor 113 through a motor driver circuit 111.

As described above, according to the present invention, since the duty variable control of the chopping pulse and the existence/inexistence of the one-shot pulse can be independently controlled by means of data in the ROM, it becomes possible to form a pulse raised by one rank without changing the duty ratio. Moreover, since an On-time of a pulse does not become narrow, it becomes possible to suppress the peak current. Further, even if a frequency multiplying circuit or the like to raise the resolution of duty variation is not used, it becomes possible to achieve an equivalent effect.

What is claimed is:

1. an analog electronic watch comprising:

an oscillation circuit;

a frequency dividing circuit for dividing an output of said oscillation circuit;

a system clock generating circuit for generating a system clock from an output of said oscillation circuit;

a ROM in which procedures such as a clocking operation of a watch are programmed;

a CPU for decoding data programmed in said ROM and for performing various arithmetic processes;

a RAM for storing various data;

an interrupt signal generating circuit for generating an interrupt signal to said CPU;

a chopping pulse generating circuit which receives a timing signal from said frequency dividing circuit and causes a duty of a chopping pulse to be variable;

a one-shot pulse generating circuit which receives an end signal of a motor driving pulse outputted from said chopping pulse generating circuit and a timing signal from said frequency dividing circuit, and outputs a one-shot pulse;

a pulse rank storage circuit for storing pulse states of said chopping pulse generating circuit and said one-shot pulse generating circuit;

a motor driver circuit which receives outputs of said chopping pulse generating circuit and said one-shot pulse generating circuit and drives a motor;

a motor driven by said motor driver circuit; and a rotation detecting circuit for detecting rotation/non-rotation of said motor, characterized in that said chopping pulse generating circuit and said one-shot pulse generating circuit can independently control variation of the duty and generation of the one-shot pulse by said CPU in accordance with the data of said ROM.

2. The analog electronic watch as recited in claim 1, characterized in that the analog electronic watch comprises said one-shot pulse generating circuit which receives a timing signal from said frequency dividing circuit and outputs a one-shot pulse, and the chopping pulse generating circuit which receives an end signal of a motor driving pulse outputted from said one-shot pulse generating circuit and a timing signal from said frequency dividing circuit, and causes the duty of the chopping pulse to be variable.

* * * * *